US009284681B1

(12) United States Patent
Hays, Jr.

(10) Patent No.: US 9,284,681 B1
(45) Date of Patent: Mar. 15, 2016

(54) ADJUSTABLE IRON HOLDER WITH REMOVABLE DRAIN RECEPTACLE

(71) Applicant: John N. Hays, Jr., Jersey Village, TX (US)

(72) Inventor: John N. Hays, Jr., Jersey Village, TX (US)

( * ) Notice: Subject to any disclaimer, the term of this patent is extended or adjusted under 35 U.S.C. 154(b) by 0 days.

(21) Appl. No.: 14/549,497

(22) Filed: Nov. 20, 2014

Related U.S. Application Data

(60) Provisional application No. 61/906,411, filed on Nov. 20, 2013.

(51) Int. Cl.
*D06F 79/02* (2006.01)
*D06F 75/40* (2006.01)

(52) U.S. Cl.
CPC ..... *D06F 79/02* (2013.01); *D06F 75/40* (2013.01)

(58) Field of Classification Search
CPC ..... D06F 79/02; D06F 79/023; D06F 75/40; D06F 81/003; B23K 3/00; B23K 3/027
USPC ..... 38/96, 142; 248/117.2; D32/73
See application file for complete search history.

(56) References Cited

U.S. PATENT DOCUMENTS

| | | | | | |
|---|---|---|---|---|---|
| 2,529,132 | A | | 11/1850 | Burnish, III et al. | |
| 2,021,496 | A | | 11/1935 | Anger | |
| 2,341,090 | A | * | 2/1944 | Gey | D06F 79/02 248/117.3 |
| 2,448,227 | A | | 8/1948 | McCan | |
| 2,486,448 | A | | 11/1949 | Traxler | |
| 2,493,424 | A | | 1/1950 | Stanley | |
| 2,514,400 | A | | 7/1950 | Larkins | |
| 2,528,846 | A | | 11/1950 | Sitnick et al. | |
| 2,530,027 | A | | 11/1950 | Perrigo | |
| 2,584,011 | A | | 1/1952 | Greenberg et al. | |
| 2,603,438 | A | | 7/1952 | Adams | |
| 2,655,333 | A | * | 10/1953 | Taylor | D06F 79/02 248/117.2 |
| 2,982,506 | A | * | 5/1961 | Allen | D06F 79/02 248/117.2 |
| 3,315,928 | A | | 4/1967 | Morrozo et al. | |
| 3,428,280 | A | * | 2/1969 | Brandt | D06F 79/02 248/117.2 |
| 3,459,398 | A | * | 8/1969 | Agrusa | D06F 79/02 248/117.2 |
| 3,951,369 | A | * | 4/1976 | Kocsak | D06F 79/02 248/117.6 |
| D261,219 | S | * | 10/1981 | Latimer | D32/73 |
| 4,784,616 | A | * | 11/1988 | Zimmermann | D06F 75/28 248/117.4 |
| 5,315,773 | A | * | 5/1994 | Iwami | D06F 75/12 219/247 |
| 6,116,550 | A | | 9/2000 | Forbes | |
| 6,550,164 | B2 | | 4/2003 | Rosa | |
| 7,140,580 | B1 | | 11/2006 | Hays | |
| 2008/0164384 | A1 | * | 7/2008 | Rosen | D06F 79/02 248/117.1 |

OTHER PUBLICATIONS

Rubbermaid Home Products—Consumer Product Catalog, "Ironing Organizer" Model No. 2455-87.

* cited by examiner

*Primary Examiner* — Ismael Izaguirre
(74) *Attorney, Agent, or Firm* — Kenneth A. Roddy

(57) ABSTRACT

An adjustable iron holder having an outer housing with a pivoting iron holding plate for storing a steam iron in either a toe down or toe up position that is adjustable relative to a vertical axis for optimal draining, and a removable drain receptacle for collecting water drained from the iron or which may leak from the iron to reduce the formation of mineral deposits and/or rust in or on the iron. The iron holder may be provided with a removable ironing board bracket that supports a folded ironing board. A removable water cup may be provided on one side wall of the outer housing for containing a supply of water to be used by the steam iron, and a removable accessory storage cup may be provided on the opposed side wall for holding the cord of the iron or miscellaneous small items.

6 Claims, 6 Drawing Sheets

ADJUSTABLE IRON HOLDER WITH REMOVABLE DRAIN RECEPTACLE

CROSS REFERENCE TO RELATED APPLICATION

This application claims priority of U.S. Provisional Application Ser. No. 61/906,411, filed Nov. 20, 2013.

BACKGROUND OF THE INVENTION

1. Field of the Invention

This invention relates generally to holders for irons, and more particularly to an adjustable iron holder having an outer housing with a pivoting iron holding plate suitable for storing a steam iron in either a toe down or toe up position that is adjustable relative to a vertical axis for optimal draining, and a removable drain receptacle for collecting water drained from the iron or which may leak from the iron to reduce the formation of mineral deposits in or on the iron.

2. Background Art

Various types of iron holders have been patented and are known in the prior art. However, most of the prior art iron holders are of complex construction, do not allow the placing of an iron into the holder in a adjustable toe down position relative to a vertical axis when not in use for optimal draining, and do not have a removable water receptacle for collecting water drained from the iron or which may leak from the iron to reduce the formation of mineral deposits in or on the iron.

Rubbermaid Home Products, of Fairlawn, Ohio manufactures a commercially available ironing organizer that supports an electric iron in a toe up position and has a cord storage compartment at a lower end thereof for storing the electrical cord, and a removable ironing board support bracket accessory for suspending a folded ironing board. There is no provision for adjustably positioning and draining a steam iron.

Larkins, U.S. Pat. No. 2,514,400, discloses an iron holder similar to the Rubbermaid ironing organizer that supports an electric iron in a toe up position and has a cord storage compartment at a lower end thereof for storing the electrical cord. There is no provision for adjustably positioning and draining a steam iron.

The following patents disclose iron holders of various construction having lateral side flanges or lateral side members that support an iron in a toe down position: Anger, U.S. Pat. No. 2,021,496; McCan, U.S. Pat. No. 2,448,227; Traxler, U.S. Pat. No. 2,486,448; Stanley, U.S. Pat. No. 2,493,424; Burnish III et al, U.S. Pat. No. 2,529,132; Sitnick et al, U.S. Pat. No. 2,528,846; Perrigo, U.S. Pat. No. 2,530,027; Greenberg et al, U.S. Pat. No. 2,584,011; Adams, U.S. Pat. No. 2,603,438; Morozzo et al, U.S. Pat. No. 3,315,928; Forbes, U.S. Pat. No. 6,116,550; and Rosa, U.S. Pat. No. 6,550,164. None of these patents have a provision for adjustably positioning and draining a steam iron.

My previous patent, Hays, U.S. Pat. No. 7,140,580, discloses an iron holder having an integrally formed iron support compartment for supporting a steam iron in either of a toe down or a toe up position, and an integrally formed reservoir compartment at a lower end spaced beneath the iron support compartment for collecting water drained from the iron. There is no provision for adjustably positioning and draining the steam iron.

SUMMARY OF THE INVENTION

The present invention is distinguished over the prior art in general, and these patents in particular by an adjustable iron holder having an outer housing with a pivoting iron holding plate for storing a steam iron in either a toe down or toe up position that is adjustable relative to a vertical axis for optimal draining, and a removable drain receptacle for collecting water drained from the iron or which may leak from the iron to reduce the formation of mineral deposits in or on the iron. The iron holding plate has a support surface configured to support the iron in a toe down position and effectively capture and guide water drained therefrom into a removable water receptacle tray. The iron holder may be provided with a removable ironing board bracket that supports a folded ironing board. A removable water cup may be provided on one side wall of the outer housing for containing a supply of water to be used by the steam iron, and a removable accessory storage cup may be provided on the opposed side wall for holding the cord of the iron or miscellaneous small items. The removable accessory storage cup may have an open bottom end or may have a bottom wall.

One of the significant features and advantages of the iron holder is that the pivoting iron holding plate may be adjustably positioned relative to a vertical axis so as to align the iron to provide optimal draining of a wide variety of makes and models of steam irons.

Another feature and advantage of the iron holder is that it supports the iron in a toe down position on a support surface configured to effectively capture and guide water drained therefrom into a removable water receptacle tray.

Another feature and advantage of the iron holder is that after the iron has drained, the water receptacle tray can be easily removed and the water contained therein disposed of.

Another feature and advantage of the iron holder is that it will significantly reduce the formation of mineral deposits in or on the iron, and reduce they likelihood of staining or damage to garments caused by mineral deposits and/or rust.

Another feature and advantage of the iron holder is that it can support a steam iron in either of a toe down or a toe up position therein.

Another feature and advantage of the iron holder is that it supports an iron in a conveniently accessible safe position when not in use.

Another feature and advantage of the iron holder is that it supports a removable water cup for containing a supply of water to be used by the steam iron, and a removable accessory storage cup that may be used for strong the cord of the iron or miscellaneous small items.

A further feature and advantage of the iron holder is that it supports an iron and a removable ironing board bracket that supports and conveniently stores a folded ironing board when not in use.

A still further feature and advantage of the iron holder is that it is simple in construction, inexpensive to manufacture, and is rugged and reliable in use.

Other features and advantages of the invention will become apparent from time to time throughout the specification and claims as hereinafter related.

DESCRIPTION OF THE PREFERRED EMBODIMENT

Figure 1:
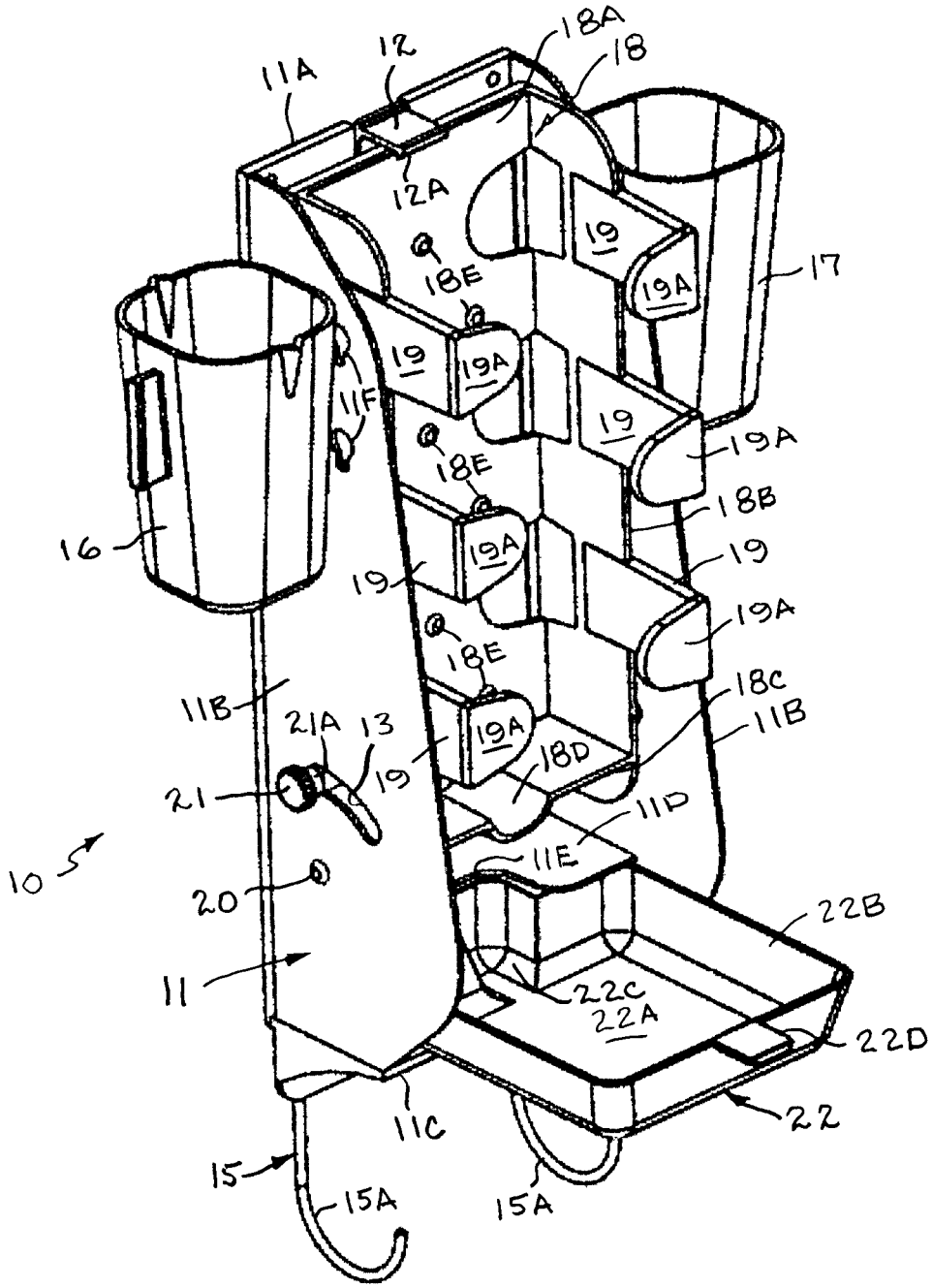
FIGS. 1 and 2 are front perspective views of the adjustable iron holder in accordance with the present invention, shown with the iron holding plate in a vertical position, and disposed at an angle relative to a vertical axis, respectively.
Figure 2:
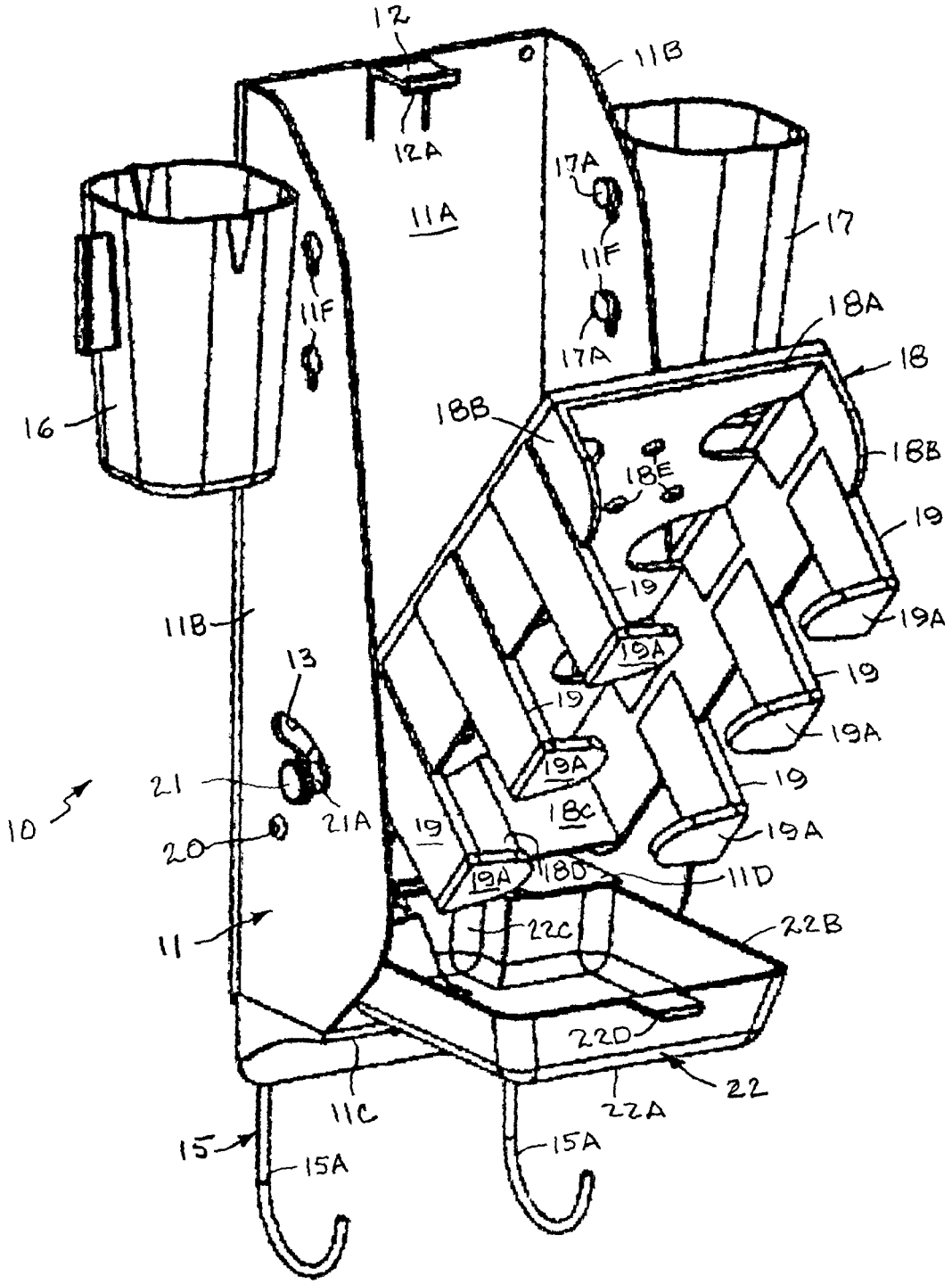
Figure 3:
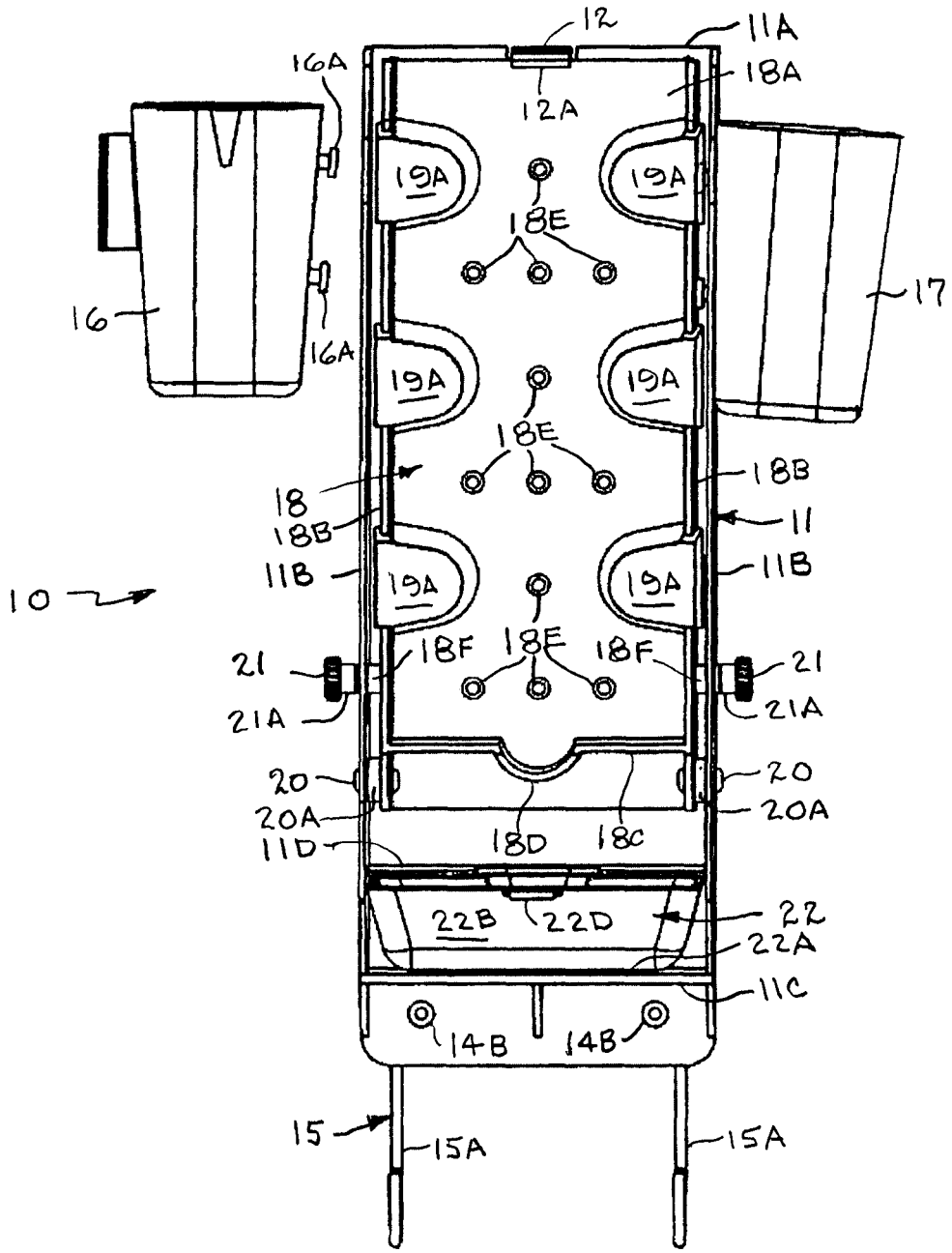
FIG. 3 is front elevation view of the adjustable iron holder.

Referring to FIGS. 1-7 of the drawings by numerals of reference, there is shown a preferred adjustable iron holder 10. As described in detail hereinafter, the major components of the adjustable iron holder 10 include an elongate generally rectangular outer (main) housing 11 that supports a pivoting iron holding plate 18 formed of heat resistant material, a removable water receptacle tray 22, a removable water supply cup 16, and a removable accessory or cord storage cup 17, each of which are preferably formed of a suitable material, such as plastic, but not limited thereto, and an accessory ironing board support bracket 15 formed of bent wire.

The outer housing 11 has an elongate vertical rear wall 11A and pair of laterally opposed vertical side walls 11B extending forwardly outward from the rear wall. A generally rectangular bottom wall 11C extends horizontally between the bottom ends of the side walls 11B and forwardly outward from the rear wall 11A, and an intermediate horizontal wall 11D disposed a distance above the bottom wall 11C extends horizontally between the lower portion of the side walls 11C and forwardly outward from the rear wall 11A, defining a generally rectangular compartment therebetween for slidably receiving and supporting a removable drain receptacle tray 22 (described hereinafter). The intermediate horizontal wall 11D may be provided with a central rearward extending arcuate recess 11E.

A generally rectangular latching tang 12 extends forwardly outward a short distance from the top end of the rear wall 11A and terminates in a small depending lip 12A, for releasably engaging the top end of the pivoting iron holding plate 18, and each of the laterally opposed vertical side walls 11B of the outer housing 11 is provided with an arcuate slot 13 radially spaced a distance from the pivot point of the iron holding plate, as described hereinafter.

Figure 5:
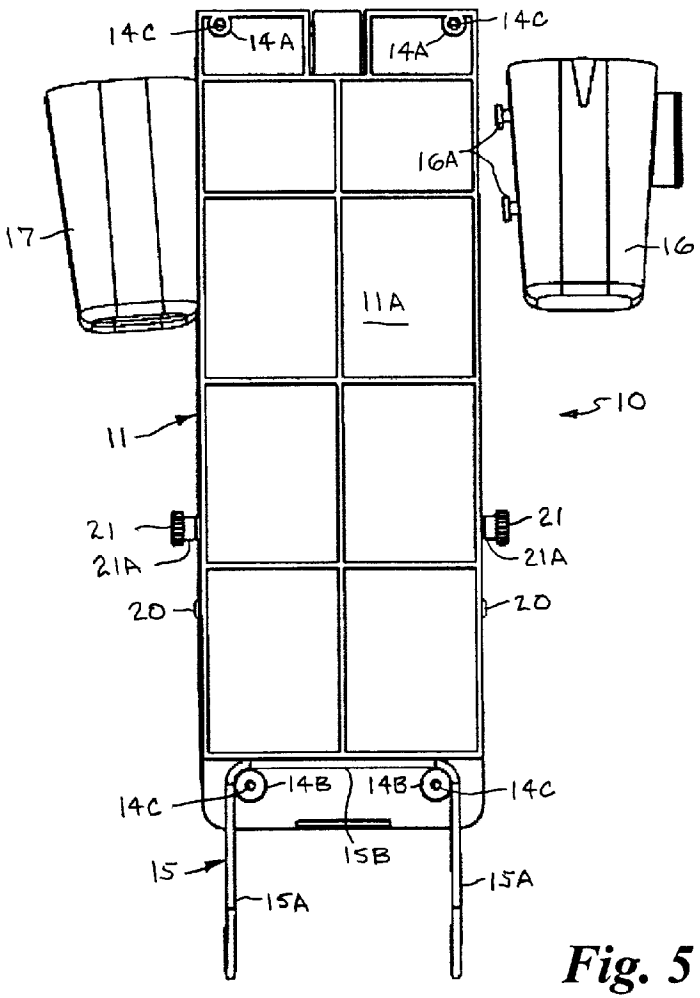
FIG. 5 is rear elevation view of the adjustable iron holder.
Figure 4:
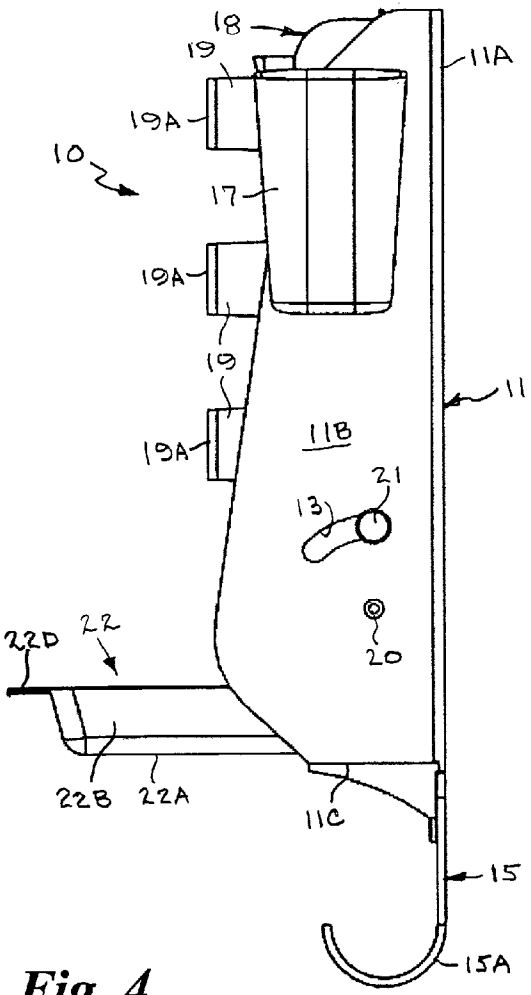
FIG. 4 is a side elevation view of the adjustable iron holder.

As best seen in FIG. 5, the back side of the rear wall 11A is provided with a pair of laterally spaced small circular protrusions 14A near its upper end and a pair of laterally spaced lower protrusions 14B near its lower end that protrude a short distance rearwardly from its back surface and each has a hole 14C therethrough for receiving a screw fastener to attach the outer housing 11 of the holder 10 to a supporting structure such as a wall or door. The holder 10 may be furnished with an accessory ironing board support bracket 15 for supporting an ironing board. A suitable ironing board support bracket 15 is formed of bent wire having a pair of laterally spaced generally J-shaped leg portions 15A adjoined at their upper ends by a straight top portion 15B. The length of the straight top portion 15B and lateral spacing of the J-shaped leg portions 15A are dimensioned such that the corner portions of the straight portion and laterally spaced leg portions may be received and supported on the outer periphery of the laterally spaced lower protrusions 15B on the back surface of the rear wall 11A of the outer housing. The ironing board support bracket 15 is captured between the back surface of the rear wall 11A of the holder 10 and the supporting structure, and a folded ironing board may be suspended therefrom by placing the laterally extending foot portions of the folded ironing board in the J-shaped leg portions 15A of the support bracket.

Each of the laterally opposed vertical side walls 11B of the outer housing 11 is provided with a pair a vertically spaced keyhole-shaped apertures 11F near their upper ends. A water cup 16 having a pair of vertically spaced protrusions 16A on one side terminating in an enlarged head may be removably received into the keyhole-shaped apertures 11F for removably mounting the water cup 16 on one side wall of the outer housing. An accessory storage cup 17 having a pair of vertically spaced protrusions 17A on one side terminating in an enlarged head may be removably received into the keyhole-shaped apertures 11F for removably mounting the storage cup on the opposed side wall of the outer housing. The water cup 16 may be used for containing a supply of water to be used by a steam iron. The accessory storage cup 17 may be used for holding the cord of the iron when not in use, or for holding miscellaneous small items. The accessory storage cup 17 may have an open bottom end or may be provided with a bottom wall.

The iron holding plate 18 has an elongate vertical rear wall 18A and pair of laterally opposed vertical side walls 18B extending forwardly outward from the rear wall. A generally rectangular bottom wall 18C extends horizontally between the side walls 18B near their bottom ends and forwardly outward from the rear wall 18A. The bottom wall 18A of the iron holding plate 18 is provided with a central downwardly extending arcuate depression 18D for receiving the toe end of an iron supported in the iron holding plate in a toe down position. The bottom wall 18A and its arcuate depression 18D slope angularly outwardly and downward from the rear wall 18A to facilitate capturing and guiding water drained from the iron into the removable water receptacle tray 22 (described hereinafter).

A plurality of vertically spaced flat generally rectangular fingers 19 extend forwardly outward a distance from the top end of the laterally opposed side walls 18B in laterally opposed relation and terminate in small laterally opposed inwardly facing retainer flanges or tangs 19A, for slidably receiving and releasably engaging opposed side portions of an iron placed into the iron holding plate 18. As described above, the iron holding plate 18 is formed of a heat resistant material, such as for example Bakelite, but not limited thereto. Depending upon the material of the iron holding plate 18, the front surface of the rear wall 18A of the iron holding plate 18 may be provided with a plurality of small raised protrusions 18E that support the bottom sole plate of the iron to prevent direct contact with the front surface of the rear wall. The iron holding plate 18 is sized and shaped to receive and store a steam iron in either a toe down or toe up position.

The iron holding plate 18 is pivotally mounted at its lower end to the outer housing 11 by a pivot connector 20 installed through the laterally opposed vertical side walls 11B of the outer housing 11 and laterally opposed vertical side walls 18B of the iron holding plate so as to pivot between an upright generally vertical position and an angular position relative to a vertical axis extending angularly outward and forward of the outer housing. A low-friction washer 20A may be installed between the opposed adjacent side wall surfaces to prevent binding.

Each of the laterally opposed vertical side walls 18B of the iron holding plate 18 is provided with a internally threaded tubular boss 18F extending outwardly therefrom disposed in alignment with the arcuate slot 13 in the side walls 11B of the outer housing 11. A knurled clamping knob 21 having a short neck portion 21A of a diameter greater than the width of the slot 13 and a threaded shank (not shown) that extends through the slot is threadedly engaged in the respective threaded bosses. Alternatively, the laterally opposed vertical side walls 18B of the iron holding plate 18 may be provided with an externally threaded shaft that extends outwardly through the arcuate slot 13 in the side walls 11B of the outer housing 11, with a knurled clamping knob 21 having a short internally threaded neck portion of a diameter greater than the width of the slot 13 threadedly engaged on the respective threaded shaft. When the clamping knobs 21 are tightened, their neck portion 21A engages the outer surface of the respective outer housing side wall 11B and prevents the iron holding plate 18 from moving relative to the outer housing 11.

When the clamping knobs 21 are loosened and the iron holding plate 18 is pivoted to the upright generally vertical position, its top end passes under the depending lip 12A of the generally rectangular latching tang 12 at the top end of the outer housing 11 to as to be releasably retained thereby. To pivot the iron holding plate 18 to an angular position relative to a vertical axis, the clamping knobs 21 are loosened and the latching tang 12 is pressed upward to disengage its depending lip 12A from the top end of iron holding plate. This allows a steam iron supported in the iron holding plate 18 in a toe down position to be angularly adjusted relative to a vertical axis so as to align the iron for optimal draining.

The water receptacle tray 22 has a flat bottom wall 22A and a raised peripheral side wall 22B forming a container for holding water drained from the iron. The rear portion of the water receptacle tray 22 is slidably received and removably supported in the generally rectangular compartment defined between side walls 11B, the bottom wall 11C, and the intermediate horizontal wall 11D of the outer housing 11, and its forward end extends a distance outwardly therefrom. The rear portion of the peripheral side wall 22B may be provided with an arcuate extension 22C that is received beneath the rearward extending arcuate recess 11E of the intermediate horizontal wall 11D of the outer housing 11. The front portion of the peripheral side wall 22B of the water receptacle tray 22 may be provided with a finger grip flange 22D to facilitate inserting and removing the tray into and from the outer housing 11.

Figure 6:
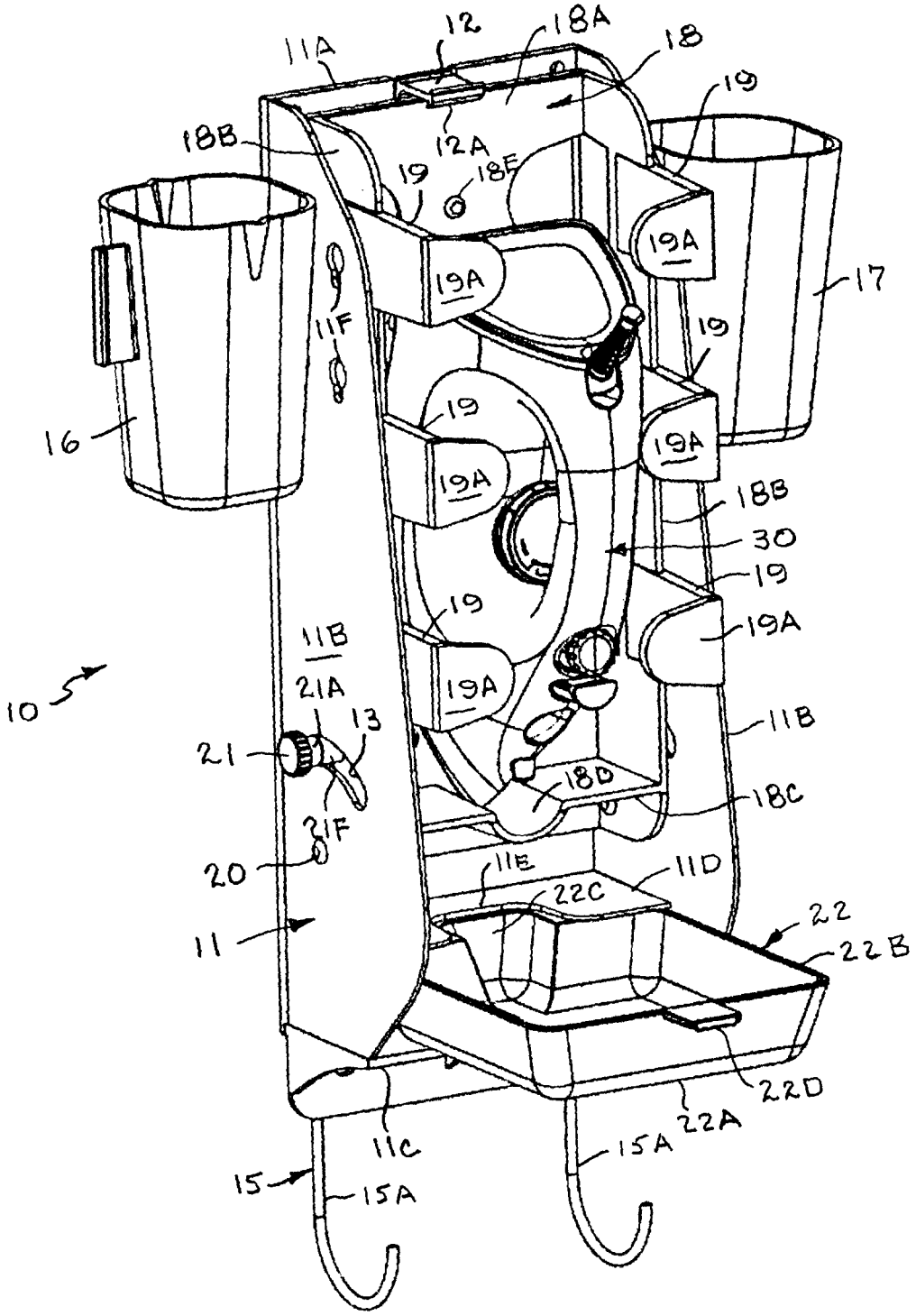
FIGS. 6 and 7 are front perspective views of the adjustable iron holder in accordance with the present invention, shown with an iron supported in the iron holding plate in a vertical toe down position, and disposed at an angle relative to a vertical axis, respectively.
Figure 7:
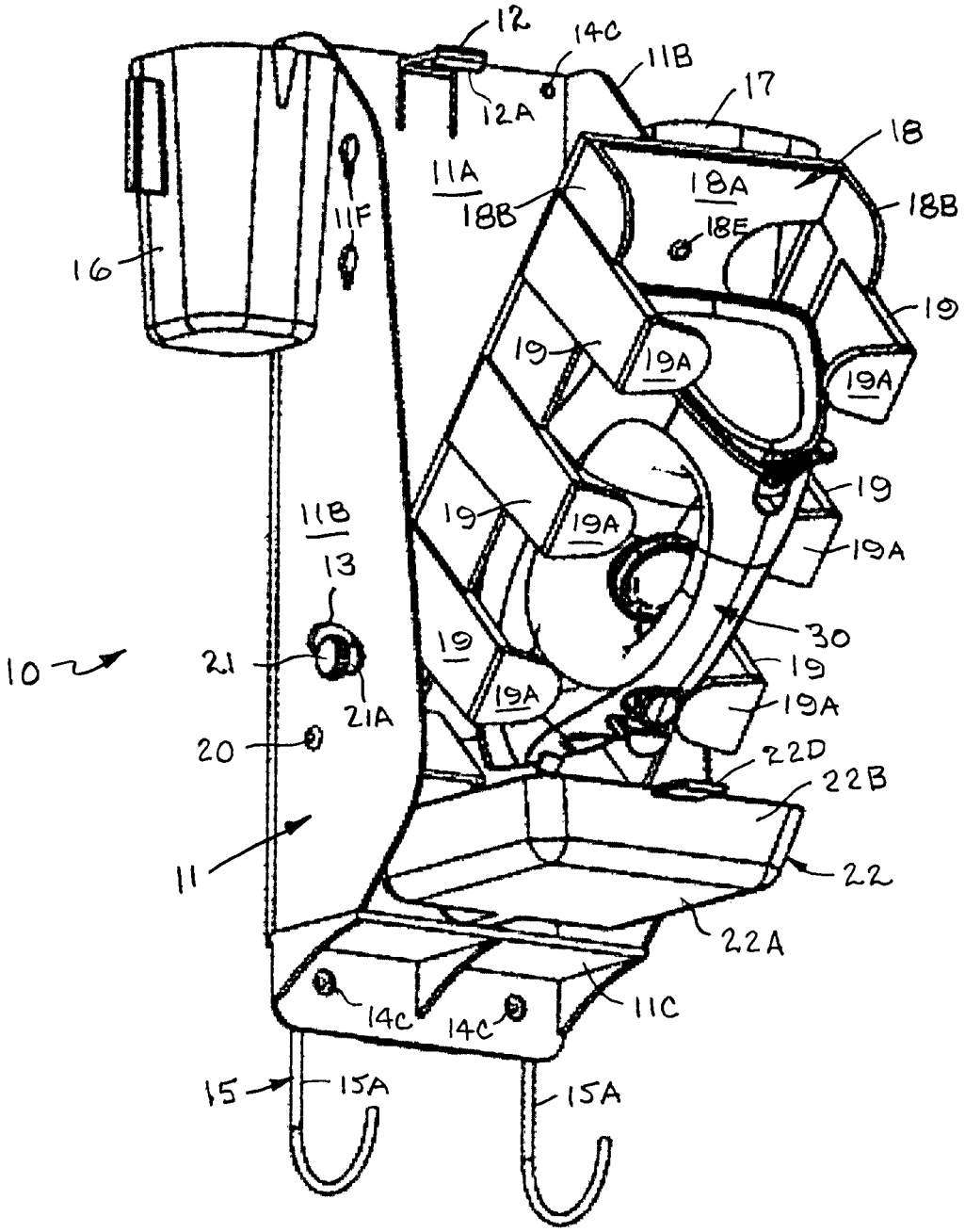

As best seen in FIGS. 6 and 7, in use of the present invention, the water receptacle tray 22 is installed in the outer housing 11, and an electric steam iron 30 in a toe down position is slid downwardly into the iron holding plate 18 between the finger and tangs 19 and 19A such that the iron will be supported therebetween with its bottom sole plate supported on the raised protrusions 18E of the iron holding plate, and its toe end engaged in the arcuate depression 18D of the bottom wall 18C of the iron holding plate.

To facilitate draining of the iron 30, the clamping knobs 21 are loosened, the latching tang 12 is pressed upward to disengage its depending lip 12A from the top end of iron holding plate 18, and the iron holding plate is pivoted forwardly to an angular position relative to a vertical axis, and the clamping knobs are then retightened. This allows the steam iron 30 to be supported in the iron holding plate 18 in a toe down position to be adjusted relative to a vertical axis so as to align the iron for optimal draining into the water receptacle tray 22, depending upon the particular make and model of the iron.

If the iron is equipped with a valve to allow water to pass outwardly from its interior reservoir, it may be opened to facilitate complete drainage of water from the iron reservoir into the water receptacle tray 22, thereby allowing the iron to empty and reducing the formation of mineral deposits on and in the iron. Any water leaking or draining from the apertures in the bottom sole plate of the iron will also run downwardly, into the arcuate depression 18D of the bottom wall 18C of the iron holding plate 18 and into the water receptacle tray 22. After the iron has drained, the water receptacle tray can be easily removed and the water contained therein disposed of.

It should be understood that after draining, the iron may also be slid downwardly into the iron holding plate 18 so that the heel portion of the iron will be supported on the bottom wall 18C thereof.

A folded ironing board may also be suspended from the ironing board support bracket 15 by placing the laterally extending foot portions of the folded ironing board in the J-shaped leg portions 15A of the bracket.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. An adjustable iron holder for supporting, storing, and draining an electric steam iron, comprising:

an outer housing having an elongate vertical rear wall, laterally opposed side walls, and a storage compartment at a lower end thereof;

a removable drain receptacle configured to be slidably received in said outer housing storage compartment for collecting and holding water drained from the iron or which may leak from the iron;

a generally rectangular iron holding plate having a rear wall, laterally opposed side walls, and a bottom wall configured to removably receive and support the steam iron therein in either a toe down or toe up position;

said iron holding plate pivotally connected at a lower end to said outer housing so as to be selectively movable relative to a vertical axis for optimal draining of the iron supported therein in a toe down position; and angular adjustment means disposed between said outer housing and said iron holding plate for adjusting and releasably retaining said iron holding plate and the iron supported therein in a toe down position at a selected angle relative to a vertical axis to facilitate optimal draining of water from the iron supported therein.

2. The adjustable iron holder according to claim 1, further comprising:

latch means at an upper end of said outer housing rear wall selectively engageable with an upper end of said iron holding plate for releasably retaining said iron holding plate in a generally vertical position.

3. The adjustable iron holder according to claim 1, wherein said iron holding plate bottom wall is sloped angularly outward and downward and has a central channel configured to channel water that may leak or drain from the iron into said removable drain receptacle.

4. The adjustable iron holder according to claim 1, further comprising:

an ironing board support bracket having a pair of laterally spaced generally J-shaped leg portions configured to be removably received and supported on said outer housing to receive laterally extending foot portions of a folded ironing board.

5. The adjustable iron holder according to claim 1, further comprising:

a water supply cup removably connected to said outer housing for containing a supply of water to be used by the steam iron, or which may be drained from the iron.

6. The adjustable iron holder according to claim 1, further comprising:

an accessory holder removably connected to said outer housing for holding the cord of the iron or miscellaneous small items.

* * * * *